US011946719B2

(12) United States Patent
Popa

(10) Patent No.: US 11,946,719 B2
(45) Date of Patent: Apr. 2, 2024

(54) MULTI-POSITION ARCHERY BOW STAND

(71) Applicant: Lawrence John Popa, Nashville, MI (US)

(72) Inventor: Lawrence John Popa, Nashville, MI (US)

( * ) Notice: Subject to any disclaimer, the term of this patent is extended or adjusted under 35 U.S.C. 154(b) by 301 days.

(21) Appl. No.: 17/402,725

(22) Filed: Aug. 16, 2021

(65) Prior Publication Data

US 2022/0049923 A1 Feb. 17, 2022

Related U.S. Application Data

(60) Provisional application No. 62/706,443, filed on Aug. 17, 2020.

(51) Int. Cl.
*F41B 5/14* (2006.01)

(52) U.S. Cl.
CPC ..... *F41B 5/1453* (2013.01)

(58) Field of Classification Search
CPC ..... F41B 5/1453; F41B 5/14; F41A 23/08; F41A 23/10
See application file for complete search history.

(56) References Cited

U.S. PATENT DOCUMENTS

| | | | | |
|---|---|---|---|---|
| 1,586,297 | A * | 5/1926 | Du Bois | B25B 7/12 81/348 |
| 6,131,556 | A | 10/2000 | Villarreal | |
| 7,032,494 | B2 * | 4/2006 | Wygant | F41A 23/08 248/440.1 |
| 9,089,978 | B2 * | 7/2015 | Carmichael | A01G 3/02 |
| 9,568,270 | B1 * | 2/2017 | LoRocco | F41B 5/1453 |
| 9,638,488 | B1 * | 5/2017 | Broberg | F41B 5/1453 |
| 2011/0138973 | A1 * | 6/2011 | Wang | B25B 7/12 81/367 |

* cited by examiner

*Primary Examiner* — Ko H Chan
(74) *Attorney, Agent, or Firm* — PATENTFILE, LLC; Bradley C. Fach; Steven R. Kick

(57) ABSTRACT

A multi-position archery bow may include a first leg assembly having a first leg, a first pivot point, a first pivot plate, and a first limb fit cartridge, and the first limb fit cartridge may comprise a first gripping projection and a second gripping projection. The stand may also include a second leg assembly having a second leg, a second pivot point, a second pivot plate, and a second limb fit cartridge, and the second limb fit cartridge may comprise a third gripping projection and a fourth gripping projection. The pivot points may be pivotally coupled together so that the stand is movable between an open position, in which the first limb fit cartridge and second limb fit cartridge may be positioned relatively farther from each other, and a closed position, in which the first limb fit cartridge and second limb fit cartridge may be positioned relatively closer to each other.

18 Claims, 11 Drawing Sheets

MULTI-POSITION ARCHERY BOW STAND

CROSS REFERENCE TO RELATED APPLICATIONS

This application claims priority to and the benefit of the filing date of U.S. Provisional Application No. 62/706,443, filed on Aug. 17, 2020, entitled "Multi-Lock-In-Positions Archery Bow Stand", which is hereby incorporated by reference in its entirety.

FIELD OF THE INVENTION

The present invention relates to novel bow stand devices used on archery bows in recreational, competition or hunting archery. More particularly, the invention relates to a bow stand device that has greater and improved adjustability so as to be used more effectively and on a plurality of archery bows having different sizes and configurations.

BACKGROUND

Having to hold one's bow in the hand can become tiresome and/or impractical when needing to take a short to an extended break from shooting one's bow. Often an archer, while not shooting their bow will have no access to an acceptable place to rest their bow in an upright and stable position to avoid laying it flat on the ground or resting surface which can lead to their bow being damaged. Additionally, current bow-stand devices have zero to limited adjustability and do not work on certain current bows and/or in certain bow configurations.

Some bow stand devices when used on certain bows and/or bow configurations can only be used when a certain length front stabilizer is attached to the bow, thus limiting the variety of bows or bow configurations the bow stand device can be used on. Some bow stand devices can also be loose fitting where it attaches to the bow and can slide or move from where attached to the bow, thus often needing to be readjusted to the preferred/best place on the bow prior to setting the bow down on a resting surface. A loose fitting bow stand device can even fall off the bow when the bow is lifted up to carry or move the bow to a new resting surface. One example of this is illustrated in Villarreal, U.S. Pat. No. 6,131,556, issued Oct. 17, 2000.

Some bow stand devices are made with non-consumer replaceable contact surfaces at the locations they attach to the bow. Over time these contact surfaces may wear out and require replacing, but this design usually results in replacing the whole bow stand device. Two examples of this are illustrated in: first—LoRocco et al., U.S. Pat. No. 9,568,270 B1, issued Feb. 14, 2017; and second—Broberg et al., U.S. Pat. No. 9,638,488 B1, issued May 2, 2017.

Some bow stand devices can have zero or minimal adjustability to fit varying types of bows or bow configurations. This can create a too tight or too loose fit, and/or a too low or too high off the ground fit on certain bows or bow configurations. When a proper, stable height off of a resting surface (often very close to the ground with a wide separation of the contact points on resting surface) is not achievable, the bow can be very unstable and can more easily tip over, which can potentially cause damage to the bow and/or any accessories attached to the bow. Two examples of these potential issues are illustrated in: first—LoRocco et al., U.S. Pat. No. 9,568,270 B1, issued Feb. 14, 2017; and second—Broberg et al., U.S. Pat. No. 9,638,488 B1, issued May 2, 2017.

Current bow stand devices that have some adjustability do not have all axis or fit of adjustability where they attach to the bow, nor do they have multiple-lock-in-positons for fit to a bow. This can create an inconsistent setting or positioning of the adjustment on each side of the bow stand device and moreover may also result in a slipping or loosening up of set position(s) over time. An example of this potential issue is illustrated in: Broberg et al., U.S. Pat. No. 9,638,488 B1, issued May 2, 2017.

Therefore, a need exists in the field of archery bow stand devices for a novel multiple-lock-in-positions bow stand device that offers: 1) separate multiple-lock-in bow stand thickness and width positions at attachment location on bow to allow best possible fit; 2) separate multiple-lock-in bow stand leg angle/width positions (relative to the center pivot point of the device) to allow the bow to be set to best height position relative to the ground at bow stand device attachment location, while also allowing widest possible contact points separation distance on resting surface for maximum stability; 3) offer consumer replaceable contact components at bow stand device attachment locations. All features combining to give an improved fit and functionality on a greater number of bows and bow configurations used in all types of archery.

BRIEF SUMMARY OF THE INVENTION

A multi-position archery bow stand is provided which may be configured to hold an archery bow upright or in a desired orientation when the stand is engaged to the bow and the stand and bow are resting on an acceptable surface. In some embodiments, the stand may include a first leg assembly having a first leg, a first pivot point, a first pivot plate, and a first limb fit cartridge. The first limb fit cartridge and the first leg may be coupled to the first pivot plate, and the first limb fit cartridge may include a first gripping projection and a second gripping projection. The first leg may include a first distal end and a first proximal end, and the first distal end and first limb fit cartridge may be positioned on opposite sides of the first pivot point. The stand may also include a second leg assembly having a second leg, a second pivot point, a second pivot plate, and a second limb fit cartridge. The second limb fit cartridge and the second leg may be coupled to the second pivot plate, and the second limb fit cartridge may include a third gripping projection and a fourth gripping projection. The second leg may include a second distal end and a second proximal end, and the second distal end and second limb fit cartridge may be positioned on opposite sides of the second pivot point. The first pivot point and second pivot point may be pivotally coupled together so that the stand is movable between an open position, in which the first distal end and second distal end may be positioned relatively closer to each other while the first limb fit cartridge and second limb fit cartridge may be positioned relatively farther from each other, and a closed position, in which the first distal end and second distal end may be positioned relatively farther from each other while the first limb fit cartridge and second limb fit cartridge may be positioned relatively closer to each other.

In further embodiments, one or more of the limb fit cartridges may be repositionably coupled to a pivot plate.

In further embodiments, one or more of the legs may be repositionably coupled to a pivot plate.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 2:
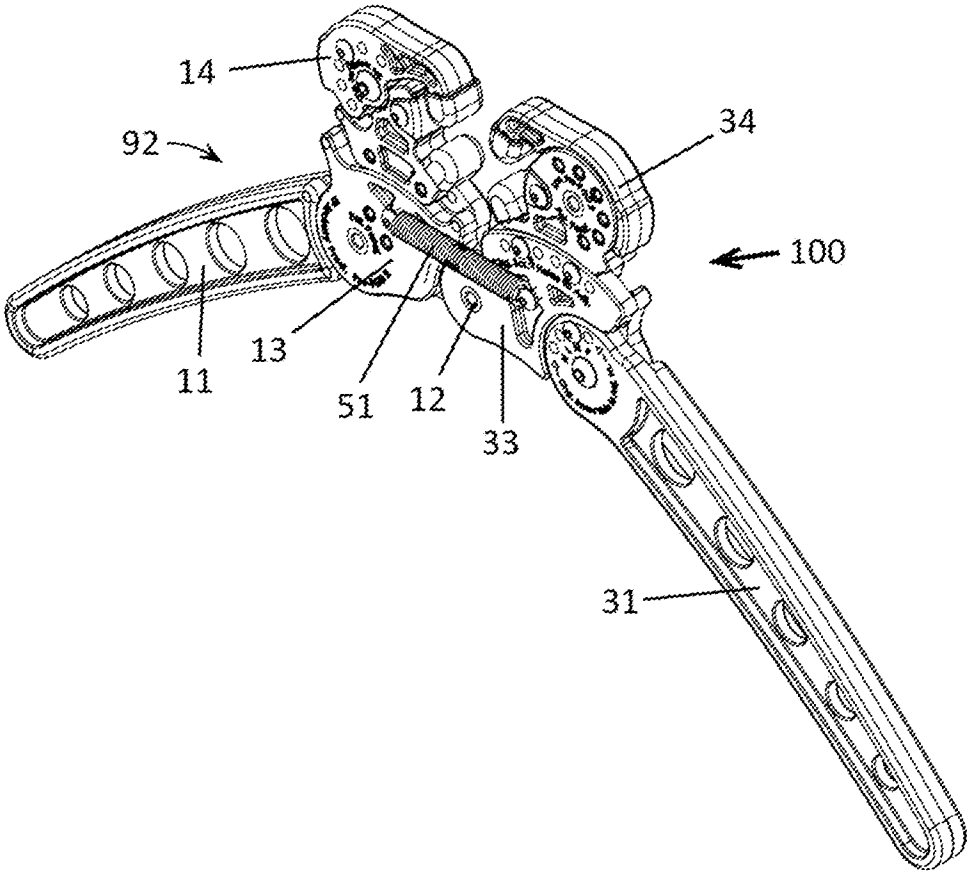
FIG. 2 illustrates a front perspective view of an example of a multi-position archery bow stand in a closed position according to various embodiments described herein.
Figure 1:
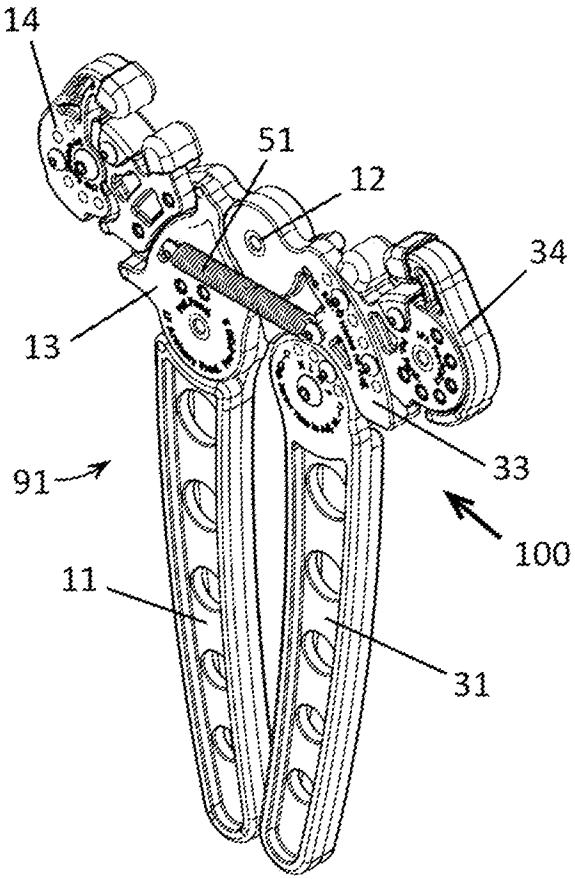
FIG. 1 depicts a front perspective view of an example of a multi-position archery bow stand in an open position according to various embodiments described herein.
Figure 4:
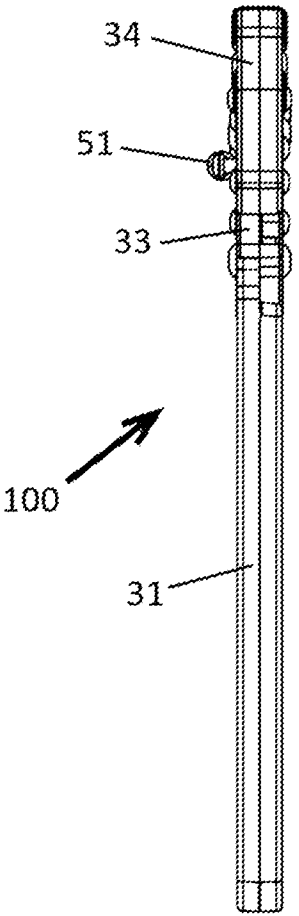
FIG. 4 depicts a side elevation view of an example of a multi-position archery bow stand according to various embodiments described herein.
Figure 3:
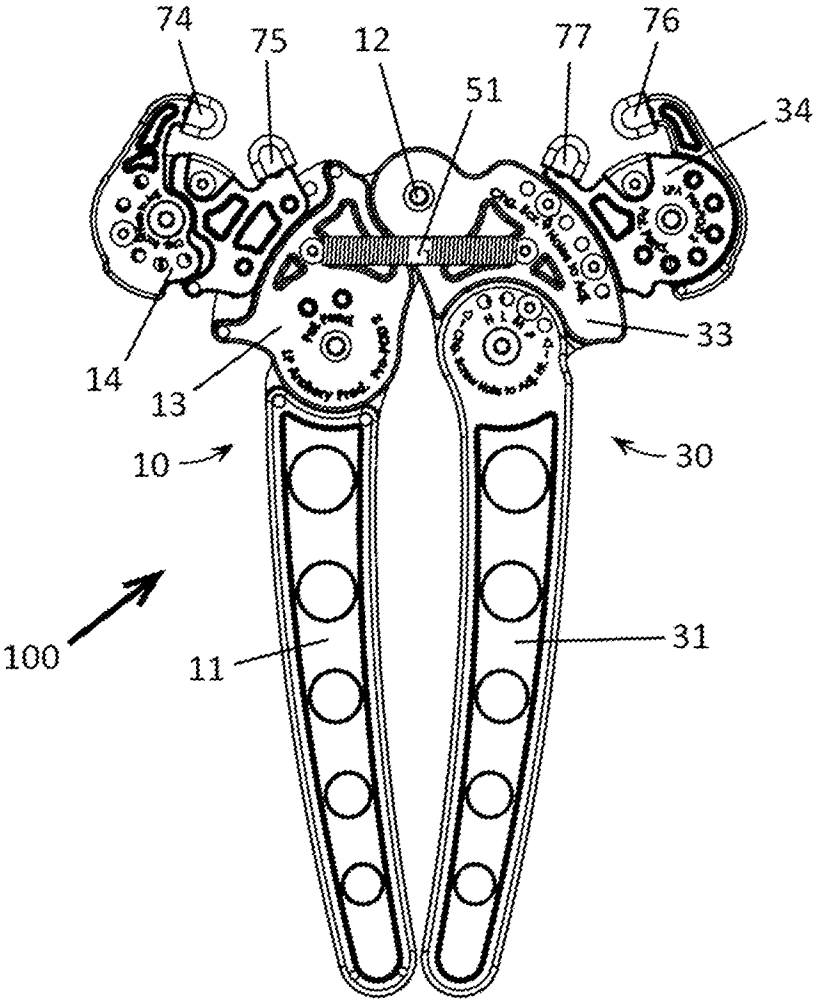
FIG. 3 shows a front elevation view of an example of a multi-position archery bow stand according to various embodiments described herein.
Figure 5:
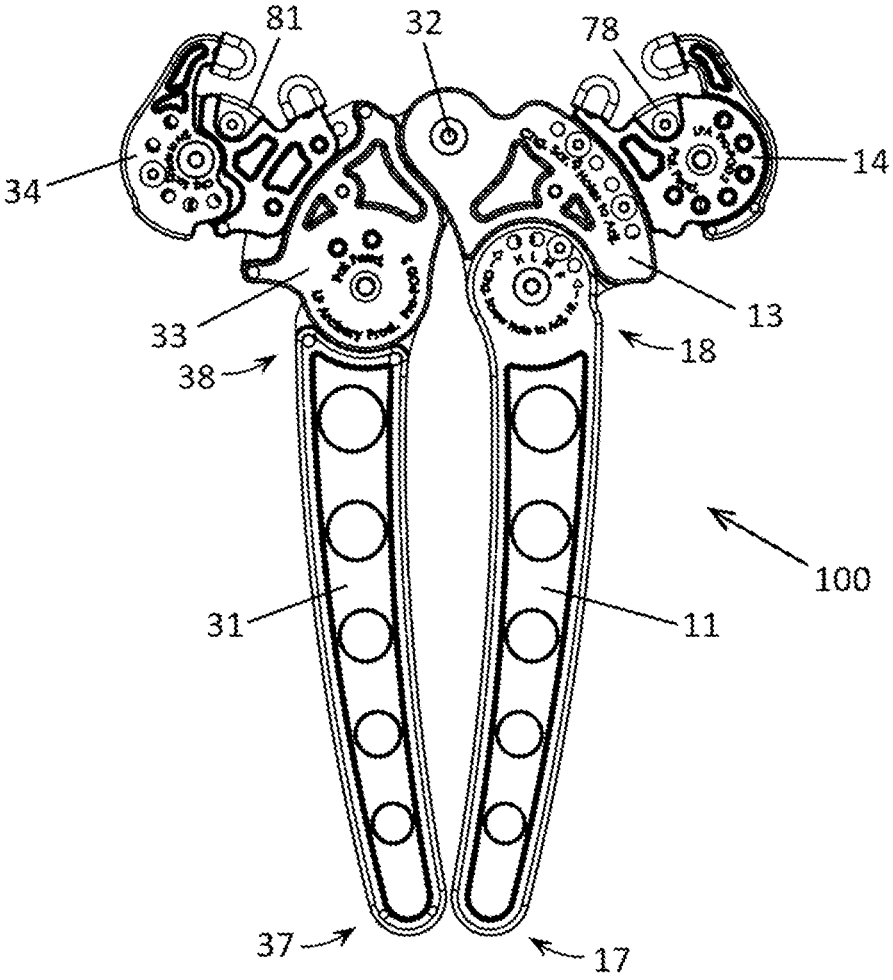
FIG. 5 illustrates a rear elevation view of an example of a multi-position archery bow stand according to various embodiments described herein.
Figure 6:
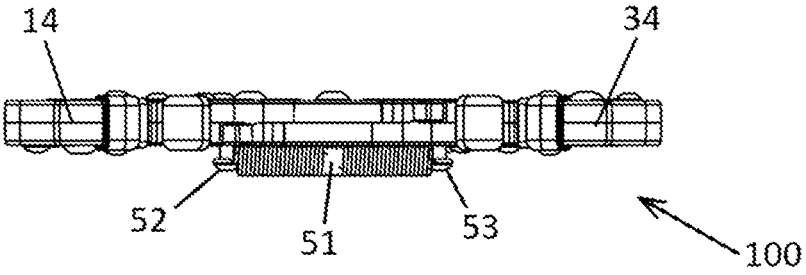
FIG. 6 shows a top plan view of an example of a multi-position archery bow stand according to various embodiments described herein.
Figure 7:
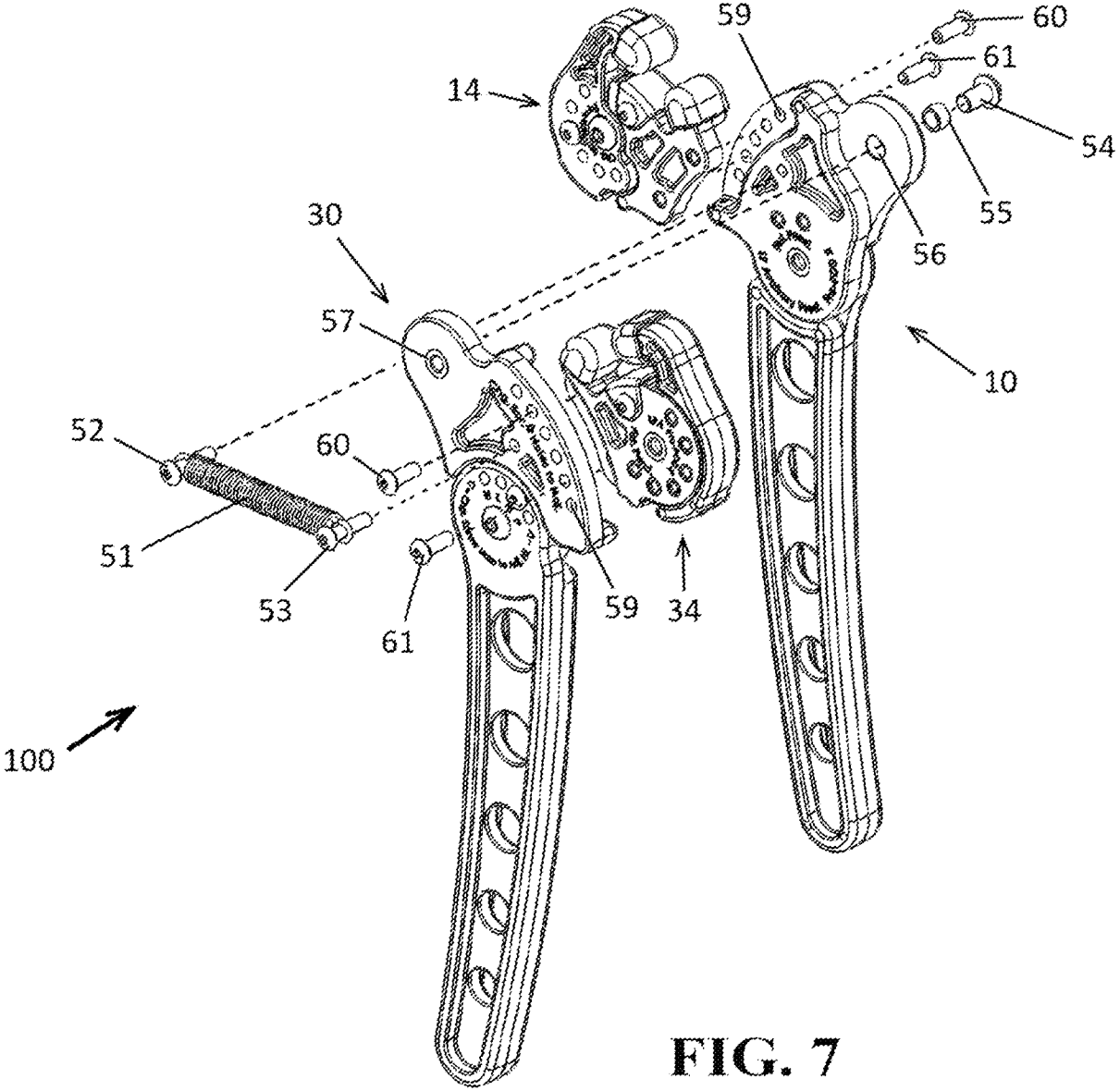
FIG. 7 depicts an exploded, perspective view of an example of a multi-position archery bow stand according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

As used in this application, the term "repositionably coupled" refers to any manner of coupling two or more elements together so that at least one of the coupled elements may be coupled to at least one of the other coupled elements in at least two different orientations, positions, locations, etc.

A new multi-position archery bow stand is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-7 and 11-16 illustrate an example of a multi-position archery bow stand ("the stand" or "the bow stand") 100 according to various embodiments. The stand 100 may be configured to hold an archery bow 200 upright or in a desired orientation when the stand 100 is engaged to the bow 200 and the stand 100 and bow 200 are resting on an acceptable surface 300. In some embodiments, the stand 100 may comprise a first leg assembly 10 having a first leg 11, a first pivot point 12, a first pivot plate 13, and a first limb fit cartridge 14. The first limb fit cartridge 14 and the first leg 11 may be coupled to the first pivot plate 13, and the first limb fit cartridge 14 may comprise a first gripping projection 15 and a second gripping projection 16. The first leg 11 may include a first distal end 17 and a first proximal end 18, and the first distal end 17 and first limb fit cartridge 14 may be positioned on opposite sides of the first pivot point 12. The stand 100 may also comprise a second leg assembly 30 having a second leg 31, a second pivot point 32, a second pivot plate 33, and a second limb fit cartridge 34. The second limb fit cartridge 34 and the second leg 31 may be coupled to the second pivot plate 33, and the second limb fit cartridge 34 may comprise a third gripping projection 35 and a fourth gripping projection 36. The second leg 31 may comprise a second distal end 37 and a second proximal end 38, and the second distal end 37 and second limb fit cartridge 34 may be positioned on opposite sides of the second pivot point 32. Optionally, one or more of the limb fit cartridges 14, 34, may be repositionably coupled to a pivot plate 13, 33. Optionally, one or more of the legs 11, 31, may be repositionably coupled to a pivot plate 13, 33. The first pivot point 12 and second pivot point 32 may be pivotally coupled together so that the stand 100 is movable between an open position 91, in which the first distal end 17 and second distal end 37 may be positioned relatively closer to each other while the first limb fit cartridge 14 and second limb fit cartridge 34 may be positioned relatively farther from each other, and a closed position 92, in which the first distal end 17 and second distal end 37 may be positioned relatively farther from each other while the first limb fit cartridge 14 and second limb fit cartridge 34 may be positioned relatively closer to each other.

Preferably, the stand 100 generally comprises a first 10 and a second 30 leg assembly that may be movably coupled together at their respective pivot points 12, 32, in order to enable pivoting/rotating of the first 10 and a second 30 leg assemblies relative to each other so that the stand 100 may be moved into and between the open 91 and closed 92 positions. Pivot points 12, 32, may comprise any suitable method or fastener which may be used to pivotally couple to objects together. For example, a first pivot point 12 may comprise a pivot fastener 54, such as a screw, that may be inserted into a pivot spacer 55 and through a pivot aperture 56 in a first pivot plate 13 to be engaged with a pivot threaded insert 57 coupled to the second pivot plate 33 so that the pivot fastener 54 provides the axis of pivot for the leg assemblies 10, 30.

In the open position 91, the stand 100 may preferably configured for storage with the first distal end 17 and second distal end 37 being positioned relatively closer to each other while the first limb fit cartridge 14 and second limb fit cartridge 34 being positioned relatively farther from each other. Additionally, while in the open position 91, the limb fit cartridges 14, 15, may be spaced apart to allow the insertion and removal of a desired portion of one or more bow limbs 201, 201A, 201B, between the limb fit cartridges 14, 15. In the closed position 92, the stand 100 may preferably configured for supporting a bow 200, having a cam 202 or other element resting on a surface 300, with the first distal end 17 and second distal end 37 being positioned relatively farther from each other while the first limb fit cartridge 14 and second limb fit cartridge 34 being positioned relatively closer to each other to grip and contact a desired portion of one or more bow limbs 201, 201A, 201B, between the limb fit cartridges 14, 15. Additionally, the relatively wider distance between the distal ends 17, 37, may provide two widely spaced points of contact for a surface 300 that the stand 100 and bow 200 may rest on, thereby increasing the stability of the stand 100 and bow 200.

In preferred embodiments, the stand 100 may comprise a tensioner 51 that may be configured to bias the stand 100 into the closed 92 and/or open position 91. A tensioner 51 may be coupled to any location or component of a first leg assembly 10 and also to any location or component of a second leg assembly 30. Preferably, a tensioner 51 may be coupled to the leg assemblies 10, 30, so that the tensioner 51 may be offset from the pivot points 12, 32, (so that the tensioner 51 is in a different plane than the pivot points 12, 32, as perhaps best shown in FIGS. 4 and 6.

Figure 8B:
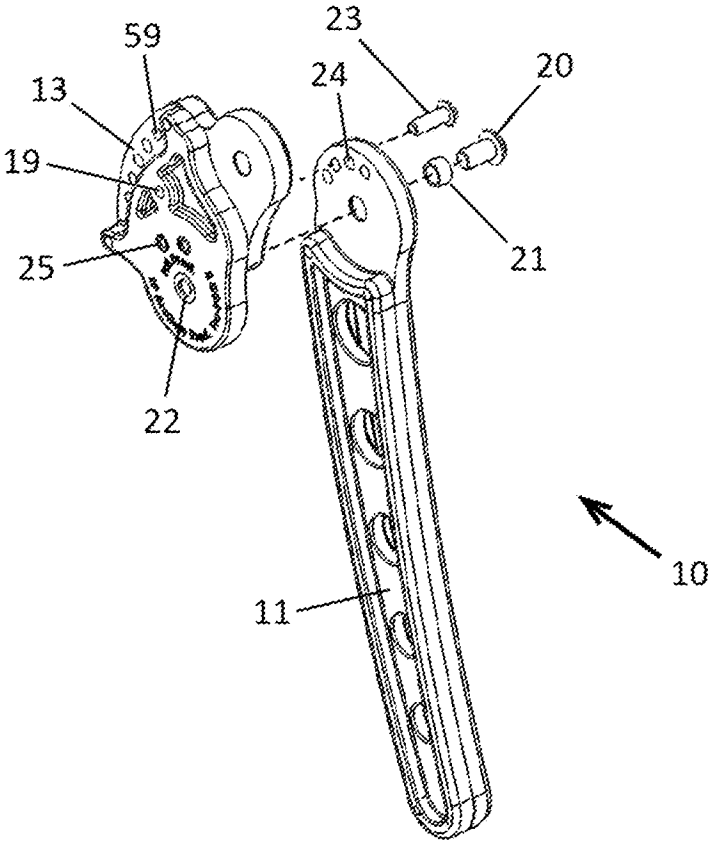
FIG. 8B illustrates a rear perspective view of the example first leg and first pivot plate of FIG. 8A according to various embodiments described herein.
Figure 8A:
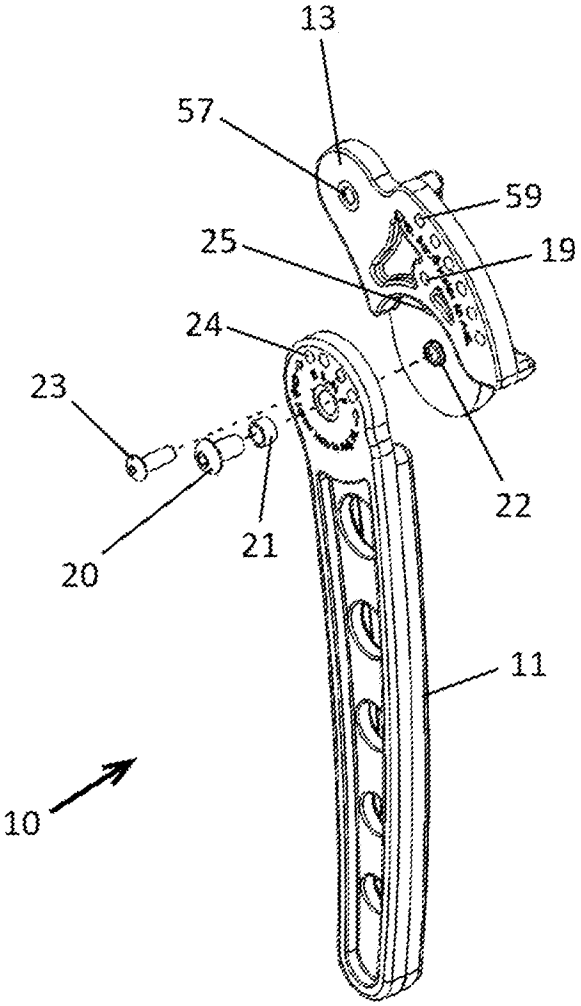
FIG. 8A illustrates a front perspective view of an example of a first leg and a first pivot plate according to various embodiments described herein.
Figure 9B:
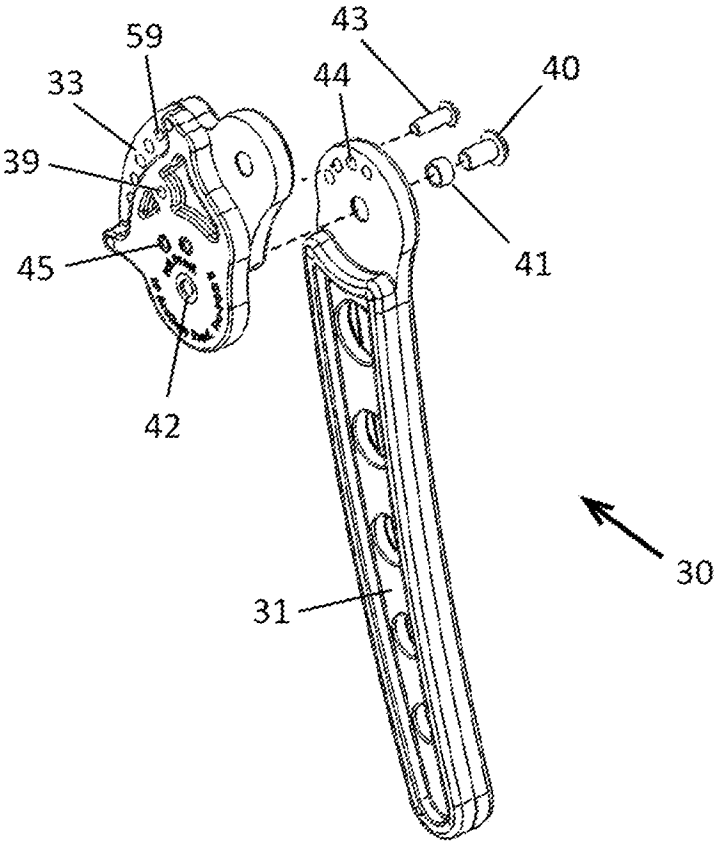
FIG. 9B shows a rear perspective view of the example second leg and second pivot plate of FIG. 9A according to various embodiments described herein.
Figure 9A:
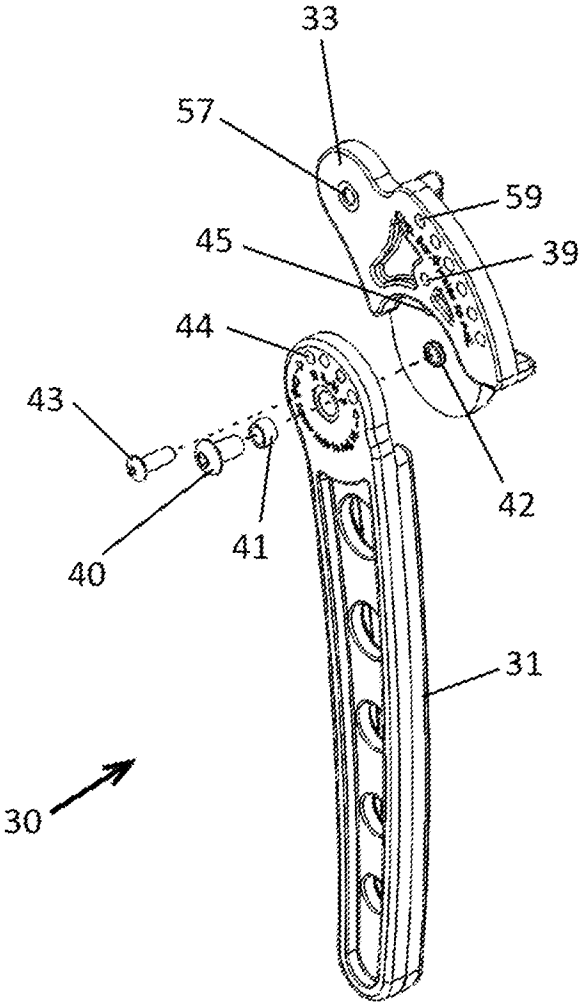
FIG. 9A shows a front perspective view of an example of a second leg and a second pivot plate according to various embodiments described herein.
Figure 10A:
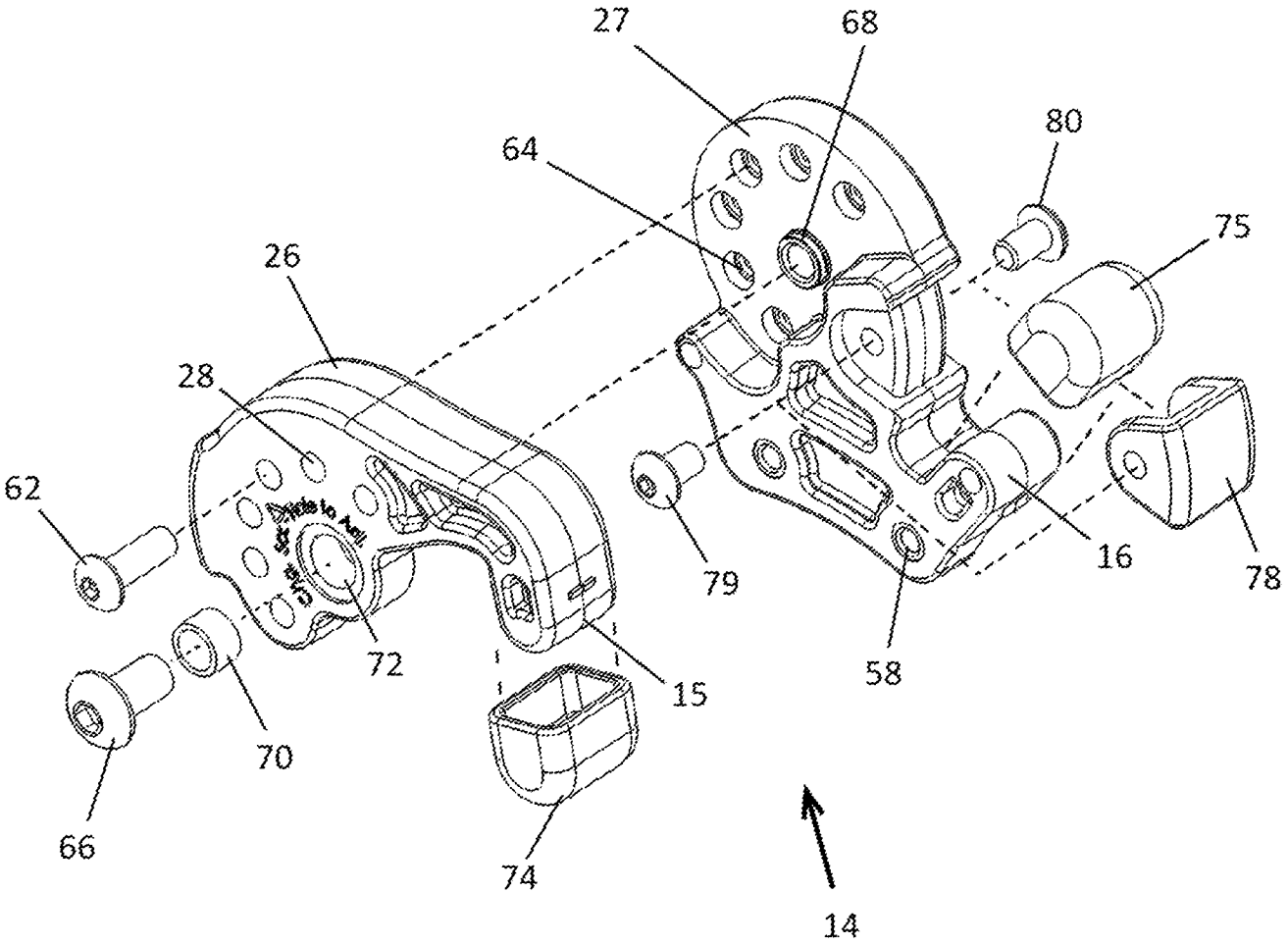
FIG. 10A depicts a perspective exploded view of an example of a first limb fit cartridge according to various embodiments described herein.
Figure 10B:
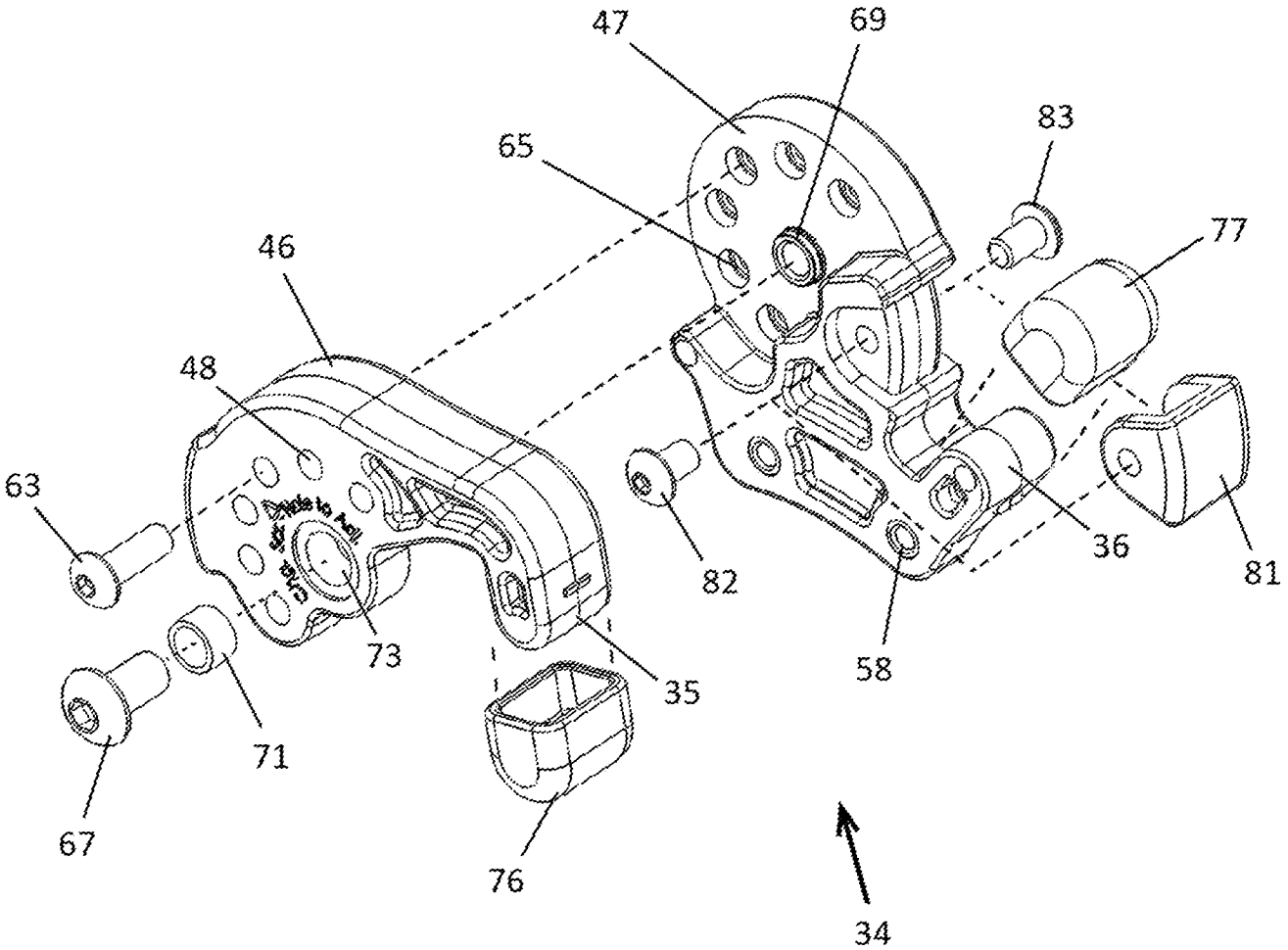
FIG. 10B depicts a perspective exploded view of an example of a second limb fit cartridge according to various embodiments described herein.
Figure 12:
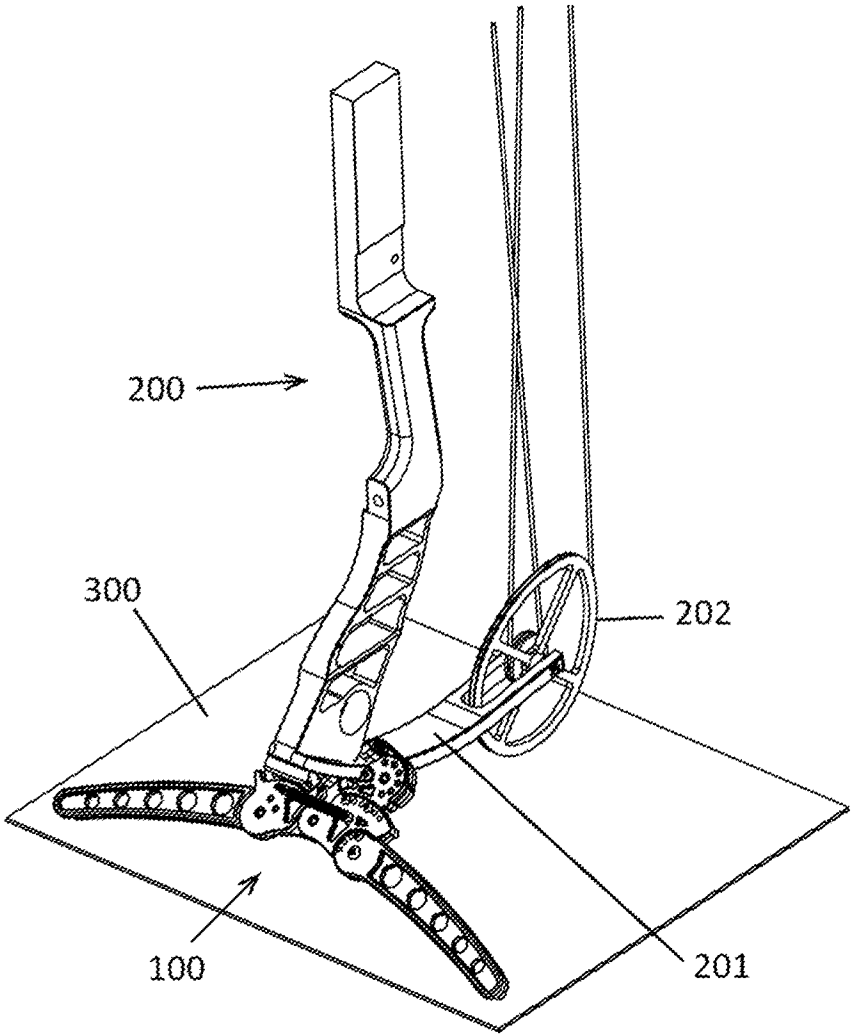
FIG. 12 shows a partial, front perspective view of the multi-position archery bow stand of FIG. 11 according to various embodiments described herein.
Figure 11:
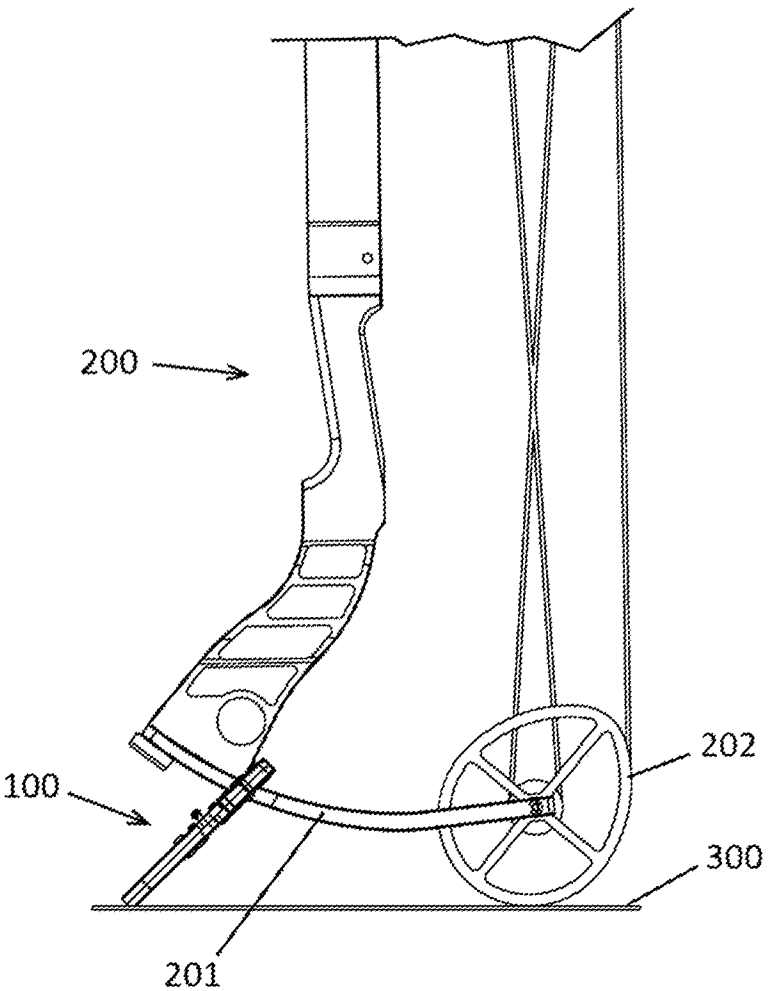
FIG. 11 illustrates a partial, side elevation view of an example of a multi-position archery bow stand resting on surface and engaged to a thick, narrow solid bow limb of an example bow, with cam of bow resting on surface, according to various embodiments described herein.

Any suitable coupling method or device may be used to couple a tensioner 51 to a leg assembly 10, 30. For example, a first leg assembly 10 may comprise one or more first tensioner apertures 19 which may be disposed on an element of the first leg assembly 10, such as the first pivot plate 13, and the second leg assembly 30 may comprise one or more second tensioner apertures 39 which may be disposed on an element of the second leg assembly 30, such as the second pivot plate 33 with the tensioner 51 coupled to the leg assemblies 10, 30, via a tensioner fastener 52, 53, such as a screw, rivet, welding, etc., that is coupled to the tensioner apertures 19, 39, (FIGS. 8 and 9).

In some embodiments, the stand 100 may comprise a tensioner 51 that may be configured to tension the stand 100 in the closed position 92, such as by having the tensioner 51 coupled to the first pivot plate 13 and to the second pivot plate 33 below the pivot points 12, 32, when the stand is in the open position 91. In still further embodiments, the stand 100 may comprise a tensioner 51 that may be configured to tension the stand 100 in the open position 91, such as by having the tensioner 51 coupled to the first pivot plate 13 and to the second pivot plate 33 above the pivot points 12, 32, when the stand is in the open position 91.

In some embodiments, a tensioner 51 may comprise a spring, such as a coil spring, which is an elastic object used to store mechanical energy and which may be made from out of spring steel, annealed steel which is hardened after fabrication, and non-ferrous metals including phosphor bronze, titanium, beryllium copper, or any other suitable material. A tensioner 51 may comprise any type of spring such as a Tension/extension spring, Compression spring, Constant-force spring, Torsion spring, Variable spring, Coil spring, Flat spring, Machined spring, Serpentine spring, Cantilever spring, Hairspring or balance spring, Leaf spring, V-spring, Belleville washer or Belleville spring, Gas spring or gas piston, Mainspring, Negator spring, Progressive rate coil springs, Spring washer, Torsion spring, Wave spring, Rubber band, bungee cord, or other non-metallic elastic material, or any other material or device which is suitable for tensioning or biasing a portion of a first leg assembly 10 to a portion of a second leg assembly 30.

The stand 100 may comprise two legs 11, 31, which may be configured to support the stand 100 above a surface 300. The first leg 11 may include a first distal end 17 and a first proximal end 18, and the second leg 31 may comprise a second distal end 37 and a second proximal end 38. Generally, the proximal ends 18, 38, may be coupled to the one of the pivot plates 13, 33, while the distal ends 17, 37, may rest on a surface 300 when the stand is in the closed position 92 and engaged to a bow 200. The legs 11, 31, may be configured in any shape and size. Preferably, the legs 11, 31, may be elongated in shape so that the distal ends 17, 37, may be separated from the proximal ends 18, 38, by greater than two inches, such as between approximately three and twelve inches.

In some embodiments, a leg 11, 31, may be fixedly or generally non-movably coupled to a pivot plate 13, 33. In preferred embodiments, the first leg 11 may be repositionably coupled to the first pivot plate 13, and/or the second leg 31 may be repositionably coupled to the second pivot plate 33. By being repositionably coupled, the position of a distal end 17, 37, relative to other elements of a leg assembly 10, 30, may be changed. In further embodiments, the first leg 11 may be pivotally coupled to the first pivot plate 13, and/or the second leg 31 may be pivotally coupled to the second pivot plate 33. In further embodiments, a leg 11, 31, may be coupled to a pivot plate 13, 33, via any other suitable coupling method.

For example, a leg 11, 31, may be pivotally coupled to a pivot plate 13, 33, via a leg fastener 20, 40, such as a screw, and leg spacer 21, 41, into a leg threaded insert 22, 42, of pivot plate 13, 33, and tightened down, yet allowing a pivoting action. As another example, a leg 11, 31, repositionably coupled to pivot plate 13, 33, via a plate fastener 23, 43, such as a screw, that may be aligned with and inserted into one of the leg apertures 24, 44, and engaged with a plate threaded insert 25, 45, in pivot plate 13, 33, and tightened down to lock-in the preferred leg 11, 31, angle/width position. The plate fastener 23, 43, may be used to lock-in each leg 11, 31, angle/width position, and I may be installed in one of four (or any other number of) leg apertures 24, 44. Engaging a plate fastener 23, 43, in each leg aperture 24, 44, changes the distance the distal ends 17, 37, of the legs 11, 31, contact points on a resting surface 300 are apart, from close to farther apart relative to each other. This in turn raises or lowers a bow 200 that the stand 100 is engaged to at attachment location on the bow 200 and the bow's 200 center of gravity, relative to the resting surface 300 the bow 200 is on. The archer can therefore set an optimal separation distance of the legs 11, 31, contact points on the resting surface 300, in order to create the most stable bow 200 stance on any acceptable resting surface 300 for their bow 200.

In some embodiments, a first limb fit cartridge 14 may be coupled to a first pivot plate 13, and a second limb fit cartridge 24 may be coupled to a second pivot plate 33. In preferred embodiments, a first limb fit cartridge 14 may be repositionably coupled to a first pivot plate 13, and/or a second limb fit cartridge 24 may be repositionably coupled to a second pivot plate 33. By being repositionably coupled, the position of a limb fit cartridge 14, 24, relative to other elements of a leg assembly 10, 30, may be changed. A limb fit cartridge 14, 34, may be coupled, and more preferably repositionably coupled, to a pivot plate 13, 33, with any suitable coupling method, fastener, etc. For example, a limb fit cartridge 14, 34, may comprise one or more cartridge apertures 58 and a pivot plate 13, 33, may comprise one or more plate apertures 59, and one or more cartridge fasteners 60, 61, such as screws, may be engaged within the cartridge apertures 58 and plate apertures 59. By having two or more cartridge apertures 58 and plate apertures 59, a limb fit cartridge 14, 24, may be repositionably coupled to a pivot plate 13, 33, depending on which cartridge apertures 58 and plate apertures 59 the cartridge fasteners 60, 61, are engaged within.

The stand 100 may comprise one or more gripping projections 15, 16, 17, 18, which may be configured to form a gripping structure for gripping portions of a bow 200, such as bow limbs 201, 201A, 201B. In preferred embodiments, the stand 100 may comprise a first limb fit cartridge 14 having a first gripping projection 15 and a second gripping projection 16 and a second limb fit cartridge 34 having a third gripping projection 35 and a fourth gripping projection 36. In some embodiments, a first limb fit cartridge 14 may comprise a first gripping plate 26 and a second gripping plate 27 with the first gripping plate 26 comprising a first gripping projection 15 and the second gripping plate 27 comprising a second gripping projection 16. In further embodiments, a second limb fit cartridge 34 may comprise a third gripping plate 46 and a fourth gripping plate 47 with the third gripping plate 46 comprising a third gripping projection 35 and the fourth gripping plate 47 comprising a fourth gripping projection 36. Optionally, a first 26 and second 27 gripping plate may be repositionably coupled together, such as by being pivotally coupled together, and/or a third 46 and fourth 47 gripping plate may be repositionably coupled together, such as by being pivotally coupled together.

The stand 100 may comprise two or more gripping projections 15, 16, 35, 16, that may be repositionably coupled together. In preferred embodiments, a first limb fit cartridge 14 may comprise a first gripping projection 15 that may be repositionable relative to a second gripping projection 16 so that the distance or space between the first gripping projection 15 and the second gripping projection 16 may be increased and decreased. In further preferred embodiments, a second limb fit cartridge 34 may comprise a third gripping projection 35 that may be repositionable relative to a fourth gripping projection 36 so that the distance or space between the third gripping projection 35 and fourth gripping projection 36 may be increased and decreased. In further preferred embodiments, a first gripping projection 15 may be pivotally coupled to a second gripping projection 16, and/or a third gripping projection 35 may be pivotally coupled to a fourth gripping projection 36. For example, a first gripping projection 15 may be coupled to a first gripping plate 26 and a second gripping projection 16 may be coupled to a second gripping plate 27. A first gripping plate fastener 66, such as a screw, may be inserted into a first gripping spacer 70 and through a first gripping pivot aperture 72 in a first gripping plate 26 to be engaged with a first gripping plate threaded insert 68 coupled to the second gripping plate 27 so that the first gripping plate fastener 66 provides the axis of pivot for the gripping plates 26, 27. Likewise, a second gripping plate fastener 67, such as a screw, may be inserted into a second gripping spacer 71 and through a second gripping pivot aperture 73 in a third gripping plate 46 to be engaged with a second gripping plate threaded insert 69 coupled to the fourth gripping plate 47 so that the second gripping plate fastener 67 provides the axis of pivot for the gripping plates 46, 47.

Any suitable coupling method or fastener may be used to enable one gripping projection 15, 16, 35, 36, to be repositionable relative to another gripping projection 15, 16, 35, 36. For example, a first gripping plate 26 may comprise two or more, such as six, gripping apertures 28, and a first gripping fastener 62 may be inserted through a desired gripping aperture 28 to be engaged to a desired gripping threaded insert 64 of the second gripping plate 27. Likewise, a third gripping plate 46 may comprise two or more, such as six, gripping apertures 48, and a second gripping fastener 63 may be inserted through a desired gripping aperture 48 to be engaged to a desired gripping threaded insert 65 of the fourth gripping plate 47.

By changing which gripping threaded insert 64, 65, and gripping apertures 28, 48, that a gripping fastener 62, 63, is installed in on gripping plates 26, 27, 46, 47, the gripping plates 26, 27, 46, 47, and their respective gripping projections 15, 16, 35, 36, will rotate to change to a more open or more closed position relative to each other and remain locked-in to that position. By changing which gripping threaded insert 64, 65, and gripping apertures 28, 48, that a gripping fastener 62, 63, is installed in that a limb fit cartridge 14, 34, uses to lock-in the position of the gripping projections 15, 16, 35, 36, the limb fit cartridge 14, 34, can lock-in to a narrow, medium or wide gripping projection 15, 16, 35, 36, separation relative to each other. Because the different positions the limb fit cartridge 14, 34, can be set at are on an arc/curve on the center main pivots provided by gripping plate fasteners 66, 67, the vertical width apart will change slightly that the gripping projection 15, 35, of a gripping plate 26, 46, is at relative to the other gripping projection 16, 36, in the other gripping plate 27, 47, at any given lock-in position the adjustable gripping projection 15, 35, is set at. This arc/curve of the center main pivots provided by gripping plate fasteners 66, 67, also aids in the removal of the bow stand 100 from the bow 200 attachment location, by moving the adjustable gripping projection 15, 35, contact points further out to the edge of the bow 200 attachment location. This limb fit cartridge 14, 34, feature creates more fine-tuned fit positions in order to enable the stand 100 to fit more bows 200 or bow configurations and bow limb 201, 201A, 201B, designs.

In some embodiments, the stand 100 may comprise one or more projection caps 74, 75, 76, 77, which may be made from or may comprise a resilient material that may be suitable for contacting portions of a bow 200 that the gripping projections 15, 16, 35, 36, be engaged to in a non-damaging manner. For example, a first projection cap 74 may be coupled to a first gripping projection 15, a second projection cap 75 may be coupled to a second gripping projection 16, a third projection cap 76 may be coupled to a third gripping projection 34, and a fourth projection cap 77 may be coupled to a fourth gripping projection 36. The gripping projections 15, 16, 35, 36, may be configured in any size and shape, and likewise a projection cap 74, 75, 76, 77, may be configured in any size and shape.

Any suitable coupling method may be used to couple a projection cap 74, 75, 76, 77, to a gripping projection 15, 16, 35, 36. In preferred embodiments, one or more projection cap 74, 75, 76, 77, may be removably coupled to a gripping projection 15, 16, 35, 36. In some embodiments, a projection cap 74, 75, 76, 77, may be removably coupled to a gripping projection 15, 16, 35, 36, by being press fit, being snap fit, via a fastener, such as a screw, via removable adhesive, or any other removably coupling method. Removably coupled projection caps 74, 75, 76, 77, may enable the end user to replace the projection caps 74, 75, 76, 77, such as to use different shaped projection caps 74, 75, 76, 77, for when they wear out, etc. In further embodiments, a projection cap 74, 75, 76, 77, may be coupled to a gripping projection 15, 16, 35, 36, with any other suitable coupling method, fastener, heat bonding, etc.

In some embodiments, the stand 100 may comprise one or more contact pads 78, 81, which may be made from or may comprise a resilient material that may be suitable for contacting, in a non-damaging manner, portions of a bow 200 that are proximate to portions of the bow 200 that are engaged to the gripping projections 15, 16, 35, 36. Generally, contact pads 78, 81, may prevent portions of the bow 200 that are between two adjacent gripping projections 15, 16, 35, 36, from rubbing or otherwise contacting against portions of the limb fit cartridges 14, 34, that are structurally supporting the gripping projections 15, 16, 35, 36.

In some embodiments, the stand 100 may comprise a first contact pad 78 that may be coupled to a first limb fit cartridge 14, such as to a second gripping plate 27 proximate to a second gripping projection 16, and a second contact pad 81 that may be coupled to a second limb fit cartridge 34, such as to a fourth gripping plate 47 proximate to a fourth gripping projection 36. While any suitable coupling method, fastener, etc., may be used to couple a contact pad 78, 81, to a limb fit cartridge 14, 34, in preferred embodiments, a contact pad 78, 81, may be removably coupled to a limb fit cartridge 14, 34. For example, a first contact pad 78 may be coupled to a first limb fit cartridge 14 via removable pad fasteners 79, 80, such as screws, threaded inserts etc., and a second contact pad 81 may likewise be coupled to a second limb fit cartridge 34 via removable pad fasteners 82, 83, such as screws, threaded inserts etc. Removably coupled contact pads 78, 81, may enable the end user to replace the contact pads 78, 81, such as to use different shaped contact pads 78, 81, for when they wear out, etc.

Projection caps 74, 75, 76, 77, and contact pads 78, 81, may be made from any preferably flexible and resilient material that may by suitable for contacting a bow 200 without marring or damaging the finish such as natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), or any other flexible material including combinations of materials.

In preferred embodiments, the stand 100 may comprise legs 11, 31, pivot plates 13, 33, limb fit cartridges 14, 34, and gripping projections 15, 16, 35, 36, which may be repositionable coupled together to enable the stand 100 to be engaged to a plurality of bows 200 having different sizes, shapes, and configurations. In further preferred embodiments, and as perhaps best shown in FIGS. 1-11, the stand 100 may have a total of seventy-two lock-in-position combinations so it can be custom fitted to an archer's bow 200 or bow limb 201, 201A, 201B, such as by having six lock-in limb thickness positions (provided by repositionable coupling of limb fit cartridges 14, 34, to pivot plates 13, 33), three lock-in limb width positions as part of each limb fit cartridge 14, 34, (provided by repositionable coupling of gripping plates 26, 27, 46, 47), and it has four lock-in leg angle/width positions in each leg assembly 10, 30, (provided by repositionable coupling of legs 11, 31, to pivot plates 13, 33). In other embodiments, the stand 100 may have any other number of lock-in-position combinations.

Regarding an exemplary embodiment of the bow stand 100, some or all of the main components of the leg assemblies 10, 30, may preferably made using a high glass fibers content nylon or an equally high strength moldable material and preferably configured with molded-in threaded inserts, where required. In further embodiments, projection caps 74, 75, 76, 77, and contact pads 78, 81, may preferably be made of vinyl or rubber to prevent/minimize bow limb 201, 201A, 201B, marring or damage, but may be made of a suitable alternate material. In preferred embodiments, fasteners 20, 40, 23, 43, 52, 53, 54, 60, 61, 52, 63, 66, 67, 79, 80, 82, 83, spacers 21, 41, 55, 70, 71, inserts 22, 25, 42, 45, 57, 64, 65, 68, 69, and/or tensioner 51 may be made of weather resistant materials like stainless steel, aluminum or brass, but not limited to those. In further embodiments, the bow stand 100 may be made via a machining process or a 3D printing process. In further embodiments, the components with molded-in threaded inserts 22, 25, 42, 45, 57, 64, 65, 68, 69, may use press-in inserts, threaded nuts or be tapped directly. In further embodiments, the fasteners 20, 40, 23, 43, 52, 53, 54, 60, 61, 52, 63, 66, 67, 79, 80, 82, 83, and/or spacers 21, 41, 55, 70, 71, may be replaced with snap together hardware. In further embodiments, the legs 11, 31, may be made/offered shorter and or have a different arc/radius in the shape. In further embodiments the limb fit cartridges 14, 34, or one or more of its components may be offered with different lock-in positions for future bow configurations, and be a consumer replaceable upgrade. In further embodiments some or all of the lock-in positions created using fasteners 20, 40, 23, 43, 52, 53, 54, 60, 61, 52, 63, 66, 67, 79, 80, 82, 83, with specifically positioned threaded inserts 22, 25, 42, 45, 57, 64, 65, 68, 69, or tapped holes, may be replaced with face gears or similar molded rib like features designed into the interfacing surfaces of any or all of the main components or similar variants.

The functionality and versatility of the bow stand 100, to fit varying bow configurations will now be illustrated and discussed. Referencing FIGS. 11 and 12; side and perspective views of one example of the bow stand 100, resting on surface 300, attached to a thick, narrow, solid bow limb 201 of bow 200, with cam 202 of bow 200 resting on surface 300, are depicted according to various embodiments described herein. In this example the stand 100 is attached to bow 200 with the multi-lock-in-positions set at: both limb fit cartridges 14, 34, width set to narrow or closest to center pivot points 12, 32, of the stand 100, both limb fit cartridges 14, 34, projections 15, 16, 35, 36, position set to maximum width opening, and both legs 11, 31, angle/width position set to widest/lowest to the ground setting.

Figure 14:
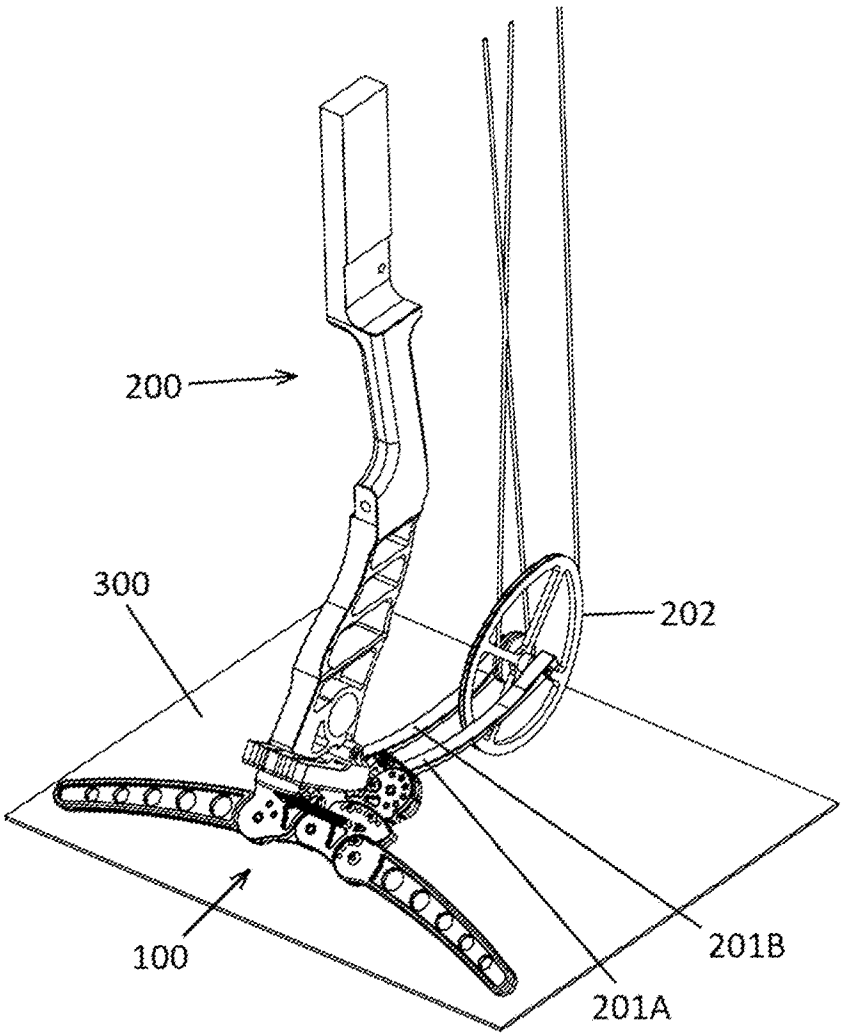
FIG. 14 illustrates a partial, front perspective view of the multi-position archery bow stand of FIG. 13 according to various embodiments described herein.
Figure 13:
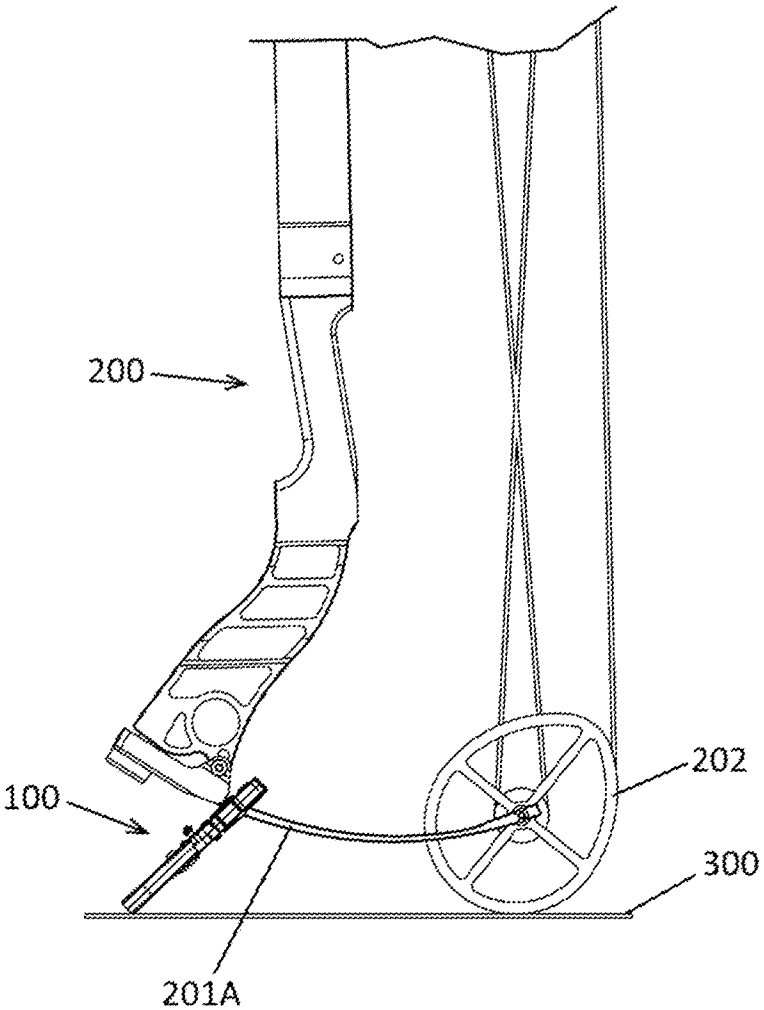
FIG. 13 depicts a partial, side elevation view of an example of a multi-position archery bow stand resting on surface and engaged to medium thick, medium width split bow limbs of another example bow, with cam of bow resting on surface, according to various embodiments described herein.

Referencing FIGS. 13 and 14, side and perspective views of one example of the stand 100, resting on surface 300, attached to medium thick, medium width, split bow limbs 201A and 201B of bow 200, with cam 202 of bow 200 resting on surface 300 are depicted, according to various embodiments described herein. In this example the stand 100 is attached to bow 200 with the multi-lock-in-positions set at: both limb fit cartridges 14, 34, width set to middle relative to center pivot points 12, 32, of the stand 100, both limb fit cartridges 14, 34, projections 15, 16, 35, 36, set to almost max width opening, and both legs 11, 31, angle/width position set to widest/lowest to the ground setting.

Figure 16:
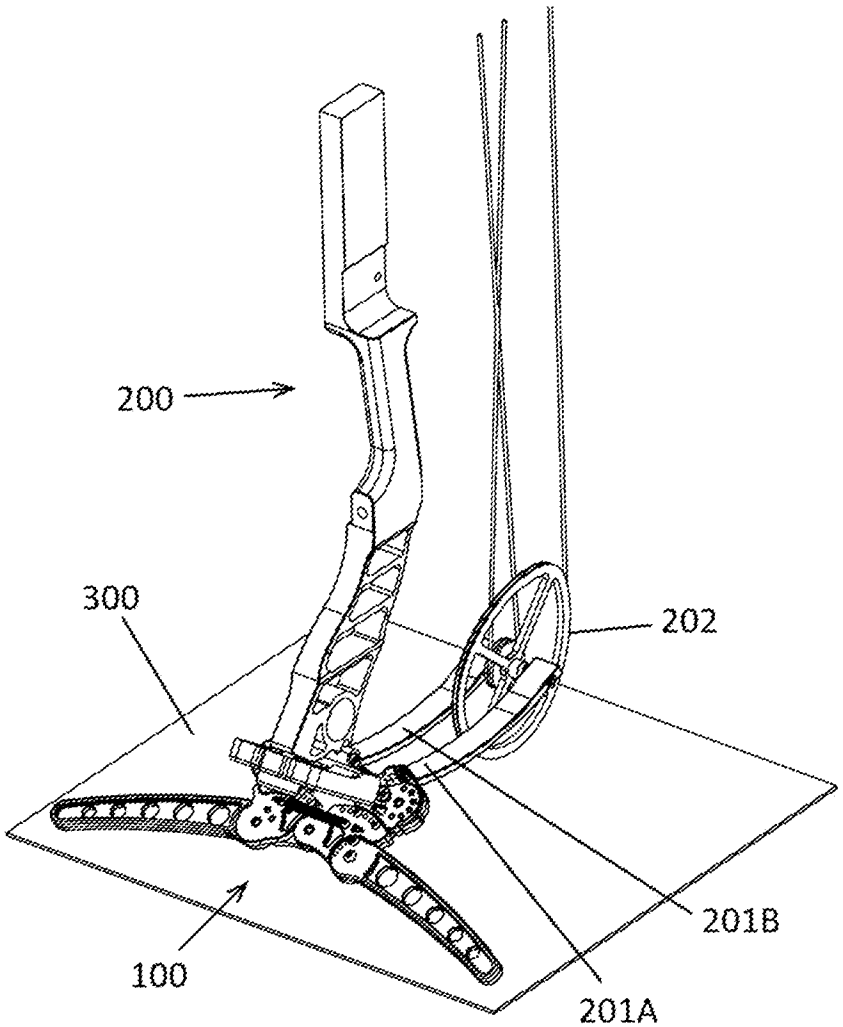
FIG. 16 depicts a partial, front perspective view of the multi-position archery bow stand of FIG. 15 according to various embodiments described herein.
Figure 15:
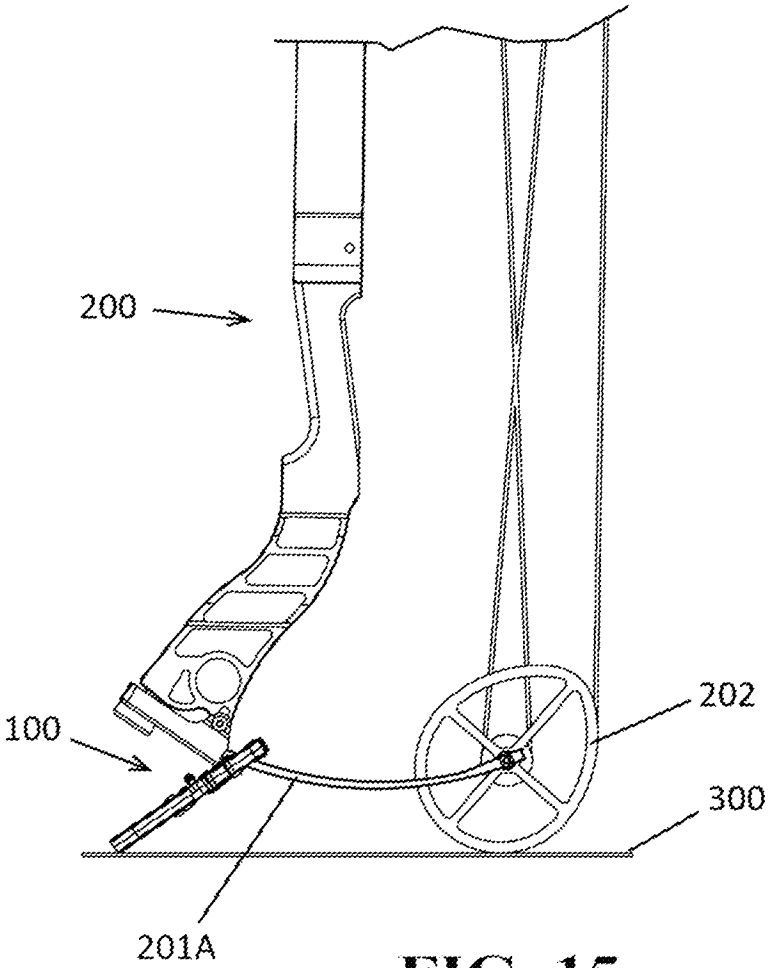
FIG. 15 shows a partial, side elevation view of an example of a multi-position archery bow stand resting on surface and engaged to thin thickness, wide width split bow limbs of yet another example bow, with cam of bow resting on surface, according to various embodiments described herein.

Referencing FIGS. 15 and 16, side and perspective views of one example of the stand 100, resting on surface 300, attached to thin, wide width, split bow limbs 201A and 201B of bow 200, with cam 202 of bow 200 resting on surface 300 are depicted according to various embodiments described herein. In this example the stand 100 is attached to bow 200 with the multi-lock-in-positions set at: both limb fit cartridges 14, 34, width set to widest position relative to center pivot points 12, 32, of the stand 100, both limb fit cartridges 14, 34, projections 15, 16, 35, 36, set to medium-wide width opening, and both legs 11, 31, angle/width position set to widest/lowest to the ground setting.

While some exemplary shapes and sizes have been provided for elements of the stand 100, it should be understood to one of ordinary skill in the art that some or all of the components of the leg assemblies 10, 30, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the stand 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the stand 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the stand 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the stand 100 may be coupled by being one of connected to and integrally formed with another element of the stand 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A multi-position archery bow stand, the stand comprising:

a first leg assembly having a first leg, a first pivot point, a first pivot plate, and a first limb fit cartridge, wherein the first limb fit cartridge and the first leg are coupled to the first pivot plate, wherein the first limb fit cartridge is repositionably coupled to the first pivot plate, wherein the first leg is repositionably coupled to the first pivot plate, wherein the first limb fit cartridge comprises a first gripping projection and a second gripping projection, wherein the first leg comprises a first distal end, and wherein the first distal end and first limb fit cartridge are positioned on opposite sides of the first pivot point;

a second leg assembly having a second leg, a second pivot point, a second pivot plate and a second limb fit cartridge, wherein the second limb fit cartridge and the second leg are coupled to the second pivot plate, wherein the second leg is repositionably coupled to the second pivot plate, wherein the second limb fit cartridge comprises a third gripping projection and a fourth gripping projection, wherein the second leg comprises a second distal end, and wherein the second distal end and second limb fit cartridge are positioned on opposite sides of the second pivot point;

wherein the first pivot point and second pivot point are pivotally coupled together so that the stand is movable between an open position, in which the first distal end is positioned relatively closer to the second distal end while the first limb fit cartridge is positioned relatively farther from the second limb fit cartridge, and a closed position, in which the first distal end is positioned relatively farther from the second distal end while the first limb fit cartridge is positioned relatively closer to the second limb fit cartridge.

2. The stand of claim 1, further comprising a tensioner that is configured to tension the stand in the closed position.

3. The stand of claim 2, wherein the tensioner is coupled to the first pivot plate and to the second pivot plate.

4. The stand of claim 1, wherein the second limb fit cartridge is repositionably coupled to the second pivot plate.

5. The stand of claim 1, wherein the first leg is pivotally coupled to the first pivot plate.

6. The stand of claim 1, wherein the first gripping projection is repositionable relative to the second gripping projection.

7. The stand of claim 1, further comprising a first projection cap that is removably coupled to one of the first gripping projection and the second gripping projection.

8. The stand of claim 7, further comprising a second projection cap that is removably coupled to one of the third gripping projection and the fourth gripping projection.

9. The stand of claim 1, further comprising a contact pad that is removably coupled to one of the first limb fit cartridge and the second limb fit cartridge.

10. A multi-position archery bow stand, the stand comprising:

a first leg assembly having a first leg, a first pivot point, a first pivot plate, and a first limb fit cartridge, wherein the first limb fit cartridge and the first leg are coupled to the first pivot plate, wherein the first leg is repositionably coupled to the first pivot plate, wherein the first limb fit cartridge comprises a first gripping projection and a second gripping projection, wherein the first leg comprises a first distal end, and wherein the first distal end and first limb fit cartridge are positioned on opposite sides of the first pivot point;

a second leg assembly having a second leg, a second pivot point, a second pivot plate and a second limb fit cartridge, wherein the second limb fit cartridge and the second leg are coupled to the second pivot plate, wherein the second limb fit cartridge comprises a third gripping projection and a fourth gripping projection, wherein the second leg comprises a second distal end, and wherein the second distal end and second limb fit cartridge are positioned on opposite sides of the second pivot point;

wherein the first pivot point and second pivot point are pivotally coupled together so that the stand is movable between an open position, in which the first distal end is positioned relatively closer to the second distal end while the first limb fit cartridge is positioned relatively farther from the second limb fit cartridge, and a closed position, in which the first distal end is positioned relatively farther from the second distal end while the first limb fit cartridge is positioned relatively closer to the second limb fit cartridge.

11. The stand of claim 10, further comprising a tensioner that is configured to tension the stand in the closed position.

12. The stand of claim 11, wherein the tensioner is coupled to the first pivot plate and to the second pivot plate.

13. The stand of claim 10, wherein the first leg is pivotally coupled to the first pivot plate.

14. The stand of claim 10, wherein the second leg is repositionably coupled to the second pivot plate.

15. The stand of claim 10, wherein the first limb fit cartridge is repositionably coupled to the first pivot plate, and wherein the second limb fit cartridge is repositionably coupled to the second pivot plate.

16. The stand of claim 10, further comprising a first projection cap that is removably coupled to one of the first gripping projection and the second gripping projection.

17. The stand of claim 16, further comprising a second projection cap that is removably coupled to one of the third gripping projection and the fourth gripping projection.

18. The stand of claim 10, further comprising a contact pad that is removably coupled to one of the first limb fit cartridge and the second limb fit cartridge.

* * * * *